US012780266B2

(12) United States Patent
Bellikka et al.

(10) Patent No.: US 12,780,266 B2
(45) Date of Patent: Nov. 3, 2026

(54) HANGING TROLLEY SYSTEM WITH BRAKE

(71) Applicant: Ford Motor Company, Dearborn, MI (US)

(72) Inventors: Glen Bellikka, Dexter, MI (US); Albert McCabe, Windsor (CA); David Marko, Britton, MI (US)

(73) Assignee: Ford Motor Company, Dearborn, MI (US)

( * ) Notice: Subject to any disclaimer, the term of this patent is extended or adjusted under 35 U.S.C. 154(b) by 772 days.

(21) Appl. No.: 18/312,337

(22) Filed: May 4, 2023

(65) Prior Publication Data

US 2024/0367693 A1 Nov. 7, 2024

(51) Int. Cl.

| | |
|---|---|
| ***B61B 13/04*** | (2006.01) |
| ***B61H 5/00*** | (2006.01) |
| ***B61H 13/02*** | (2006.01) |
| ***B61H 13/20*** | (2006.01) |

(52) U.S. Cl.

CPC ..... *B61B 13/04* (2013.01); *B61H 5/00* (2013.01); *B61H 13/02* (2013.01); *B61H 13/20* (2013.01)

(58) Field of Classification Search

CPC ..... B61B 13/04; B61H 5/00; B61H 13/02; B61H 13/20

See application file for complete search history.

(56) References Cited

U.S. PATENT DOCUMENTS

| | | | | |
|---|---|---|---|---|
| 3,774,548 | A * | 11/1973 | Borst | B61B 13/04 191/11 |
| 7,966,941 | B1 * | 6/2011 | Brannan | B60T 11/046 104/53 |
| 9,061,869 | B2 | 6/2015 | Hoffend et al. | |
| 9,381,926 | B2 | 7/2016 | Brannan | |

OTHER PUBLICATIONS

Knight Global, Electric/Pneumatic/Servo Tractor Series product pages, Oct. 20, 2022, 23 pages.

* cited by examiner

*Primary Examiner* — Robert J McCarry, Jr.
(74) *Attorney, Agent, or Firm* — Burris Law, PLLC

(57) ABSTRACT

A hanging trolley system includes a body, a plurality of first support wheels, and a brake system. The body includes upper and lower portions. The first support wheels are coupled to the upper portion of the body for rotation relative thereto about corresponding first axes that are parallel to each other. The first support wheels are configured to roll on an upward facing first surface of a rail to support the body on the rail. The brake system includes a traction wheel, a first component, and a second component. The traction wheel is coupled to the lower portion of the body for rotation relative thereto about a second axis and is configured to roll along a second surface of the rail. The first component is coupled to the traction wheel for rotation therewith. The second component is configured to selectively inhibit rotation of the first component.

20 Claims, 7 Drawing Sheets

HANGING TROLLEY SYSTEM WITH BRAKE

FIELD

The present disclosure relates to a hanging trolley system.

BACKGROUND

The statements in this section merely provide background information related to the present disclosure and may not constitute prior art.

Tools, workpieces, and other components are often suspended from an overhead rail and transported along that rail via a trolley that rides along the rail. Some trolleys are manually pulled or pushed by an operator. Operators using large or heavy tooling suspended from an overhead rail may have difficulty accounting for the tooling's momentum when positioning or moving the tool along the rail. This can be especially problematic if the tooling must be quickly and precisely positioned. Other overhead rail trolleys are driven by a motor that drives the trolley along the rail. Even these are difficult to precisely and quickly position as the operator typically must reverse the motor to slow the trolley and the operator must mentally determine when and how much to reverse the motor in order to overcome the tooling's momentum so that it stops at the desired location.

The teachings of the present disclosure overcome these and other issues with overhead trolley systems, also referred to herein as hanging trolley systems.

SUMMARY

This section provides a general summary of the disclosure and is not a comprehensive disclosure of its full scope or all of its features.

According to one form of the present disclosure, a hanging trolley system includes a body, a plurality of first support wheels, and a brake system. The body includes an upper portion and a lower portion. The first support wheels are coupled to the upper portion of the body for rotation relative thereto about corresponding first axes that are parallel to each other. The first support wheels are configured to roll on an upward facing first surface of a rail to support the body on the rail. The brake system includes a traction wheel, a first component, and a second component. The traction wheel is coupled to the lower portion of the body for rotation relative thereto about a second axis and is configured to roll along a second surface of the rail. The first component is coupled to the traction wheel for rotation therewith. The second component is configured to selectively inhibit rotation of the first component.

In variations of the system of the above paragraph, which can be implemented individually or in any combination: the second axis is parallel to the first axes; the second surface is a downward facing surface such that the traction wheel is configured to be below the first support wheels when the first support wheels support the body on the rail; the second axis is transverse to the first axes; the hanging trolley system further includes a motor drivingly coupled to the traction wheel; the hanging trolley system further includes a tensioner supported by the body and configured to bias the traction wheel toward the second surface; the tensioner includes a biaser and an arm, wherein the arm pivotably couples the traction wheel to the lower portion of the body, wherein the biaser biases the arm in a predetermined pivot direction, wherein the biaser is at least one of a spring, a gas shock, a resilient material, and an air cylinder; the hanging trolley system further includes a plurality of second support wheels coupled to the upper portion of the body for rotation relative thereto, each second support wheel being rotatable about a corresponding one of the first axes, the second support wheels being configured to roll on an upward facing third surface of the rail to support the body on the rail; the hanging trolley system further including a hand lever and a Bowden cable, wherein one end of the Bowden cable is coupled to the second component and an opposite end of the Bowden cable is coupled to the hand lever, the hand lever being configured to actuate the second component via the Bowden cable; the hanging trolley system further includes a hand lever and a cable, wherein one end of the cable is coupled to the second component and an opposite end of the cable is coupled to the hand lever, the hand lever being configured to actuate the second component via the cable, wherein the cable is a hydraulic or pneumatic cable; the hanging trolley system further including a controller and an actuator, wherein the actuator is configured to activate the second component to engage the first component, the controller being configured to send a signal to the actuator to activate the second component to engage the first component; the first component is directly coupled to the traction wheel for common rotation about the second axis therewith; the first component is directly coupled to a transmission member that is drivingly coupled to the traction wheel for rotation therewith; the first component is a brake rotor and the second component is a caliper; the hanging trolley system further including the rail.

According to a further form, the present disclosure provides a hanging trolley system including a body, a plurality of first support wheels, a traction wheel, a brake rotor, a caliper, a hand lever, and a cable. The body includes an upper portion and a lower portion. The first support wheels are coupled to the upper portion of the body for rotation relative thereto about corresponding first axes that are parallel to each other. The first support wheels are configured to roll on an upward facing first surface of a rail to support the body on the rail. The traction wheel is coupled to the lower portion of the body for rotation relative thereto about a second axis. The traction wheel is configured to roll along a second surface of the rail. The brake rotor is coupled to the traction wheel for rotation therewith. The caliper is configured to selectively inhibit rotation of the brake rotor. One end of the cable is coupled to the caliper and an opposite end of the cable is coupled to the hand lever. The hand lever is configured to actuate the caliper via the cable.

In variations of the system of the above paragraph, which can be implemented individually or in any combination: the cable is one of a hydraulic cable, a pneumatic cable, a Bowden cable, and an electrical cable; when the caliper is activated, the caliper resists rotation of the rotor by engaging the rotor with at least one of frictional force and magnetic force; the brake rotor is directly coupled to the traction wheel for common rotation about the second axis therewith.

In still another form, the present disclosure provides for a hanging trolley system including a body, a plurality of first support wheels, a plurality of second support wheels, a traction wheel, a tensioner, a brake rotor, a caliper, a hand lever and a cable. The body includes an upper portion and a lower portion. The first support wheels are coupled to the upper portion of the body for rotation relative thereto about corresponding first axes that are parallel to each other. The first support wheels are configured to roll on an upward facing first surface of a rail to support the body on the rail. The second support wheels are coupled to the upper portion of the body for rotation relative thereto. Each second support wheel being rotatable about a corresponding one of the first axes. The second support wheels being configured to roll on an upward facing third surface of the rail to support the body on the rail. The traction wheel is coupled to the lower portion of the body for rotation relative thereto about a second axis. The traction wheel is configured to roll along a second surface of the rail. The tensioner is supported by the body and configured to bias the traction wheel toward the second surface. The brake rotor is coupled to the traction wheel for rotation therewith. The caliper is configured to selectively inhibit rotation of the brake rotor. One end of the cable is coupled to the caliper and an opposite end of the cable is coupled to the hand lever. The hand lever is configured to actuate the caliper via the cable. The cable is one of a hydraulic cable, a pneumatic cable, a Bowden cable, and an electrical cable.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
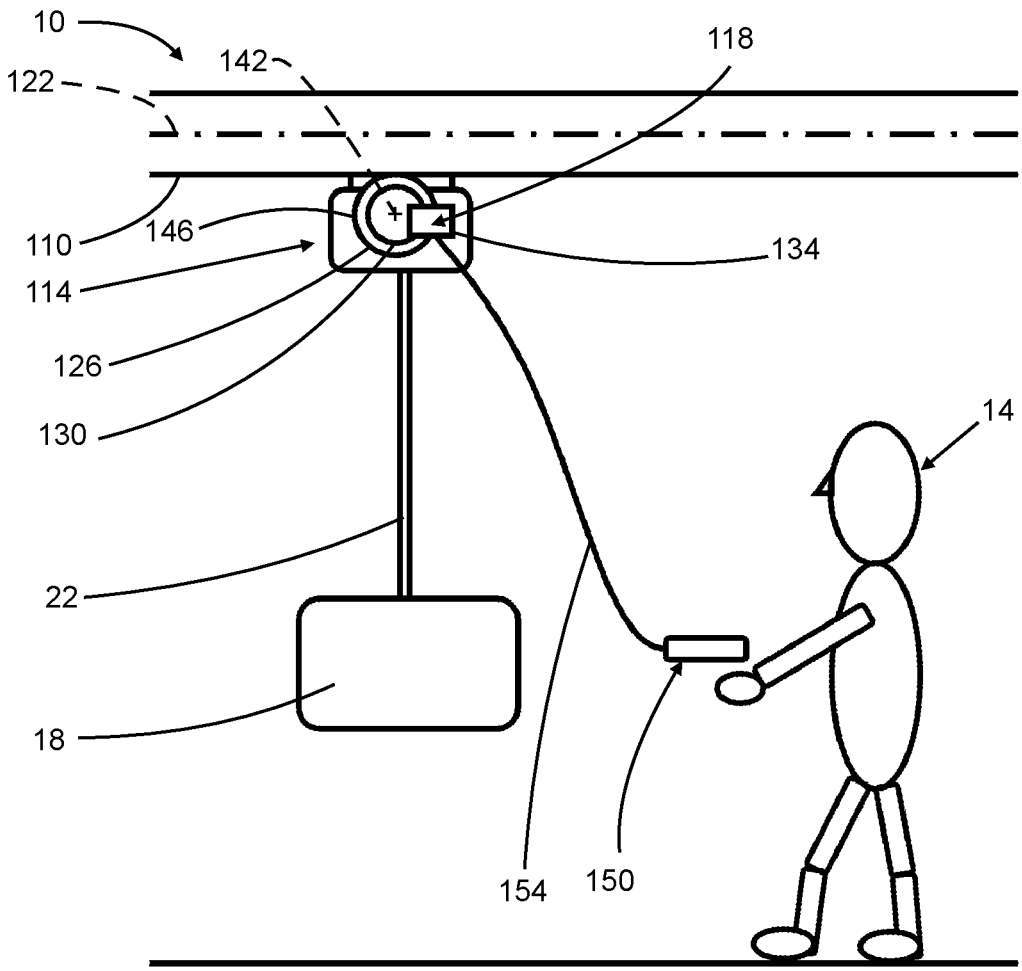
FIG. 1 is a schematic side view of a hanging trolley system according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a hanging trolley system 10 is illustrated. The hanging trolley system 10, also referred to herein as the trolley system 10, includes a rail 110, a trolley 114, and a brake system 118. The trolley 114 is supported by and hangs from the rail 110 and is configured to roll along the rail 110. The rail 110 can by any suitable type of rail, such as a C-channel or an I-beam for example, that extends longitudinally along a rail axis 122. While shown as a straight axis, the rail axis 122 may optionally curve horizontally and/or vertically such that the trolley can follow its path. Such a rail is often referred to as an "overhead rail." While the rail 110 is illustrated and described herein as being above the head of a user 14, the term "overhead rail" as used herein can include rails that are equal to or below a user's 14 head. For example, the user 14 may be on an elevated walkway (not shown) such that the user 14 is above the overhead rail 110. In other words, the term "overhead rail" is used herein to identify the type of rail used is the type commonly referred to in the art as an "overhead rail" and is not intended to limit the location of the rail relative to the user 14 or a particular floor surface.

The trolley 114 is configured to support a load 18 below the trolley 114 via a support member 22. The support member 22 may be any suitable structure that suspends the load 18 from the trolley 114. In one form, support member 22 may include a cable, rope, or other flexible support device. In another form, the support member 22 may include a rigid structure. The load 18 may be any suitable type of load, such as a large tool or a part to be assembled for example.

The brake system 118 is coupled to the trolley 114 and configured to permit the user 14 to control deceleration of the trolley 114 as it moves along the rail 110 and may optionally be used to hold the trolley 114 stationary on the rail 110. The brake system 118 includes a traction wheel 126, a first component 130, and a second component 134. The traction wheel 126 is coupled to the trolley 114 for movement therewith along the rail axis 122 and for rotation relative to the trolley 114 about its rotational axis 142. A rolling surface 146 (i.e., the outer circumferential perimeter) of the traction wheel 126 is in contact with the rail 110 such that movement of the trolley 114 along the rail 110 is configured to cause the traction wheel 126 to rotate about its rotational axis 142. In one form, the rolling surface 146 engages the rail 110 via frictional contact. In another form, such that the rolling surface 146 includes teeth (not shown; e.g., the traction wheel 126 being a pinion gear) and the rail 110 include linearly arranged teeth (not shown; e.g., the rail 110 including a rack gear) that meshingly engage the teeth of the rolling surface 146. The first component 130 is drivingly coupled to the tractions wheel 126 to rotate when the traction wheel 126 rotates. The second component 134 is configured to selectively inhibit rotation of the first component 130.

In the example provided, the brake system 118 may also include a controller 150. The controller 150 is in communication with the second component 134 and configured to control activation thereof to selectively inhibit rotation of the first component 130. In one form, the controller 150 is coupled to the second component 134 by a cable 154, though other configurations can be used. In another form, the controller 150 can be in wireless communication with the second component 134. The controller 150 is an input device configured to permit the user 14 to selectively control operation of the second component 134.

Figure 2:
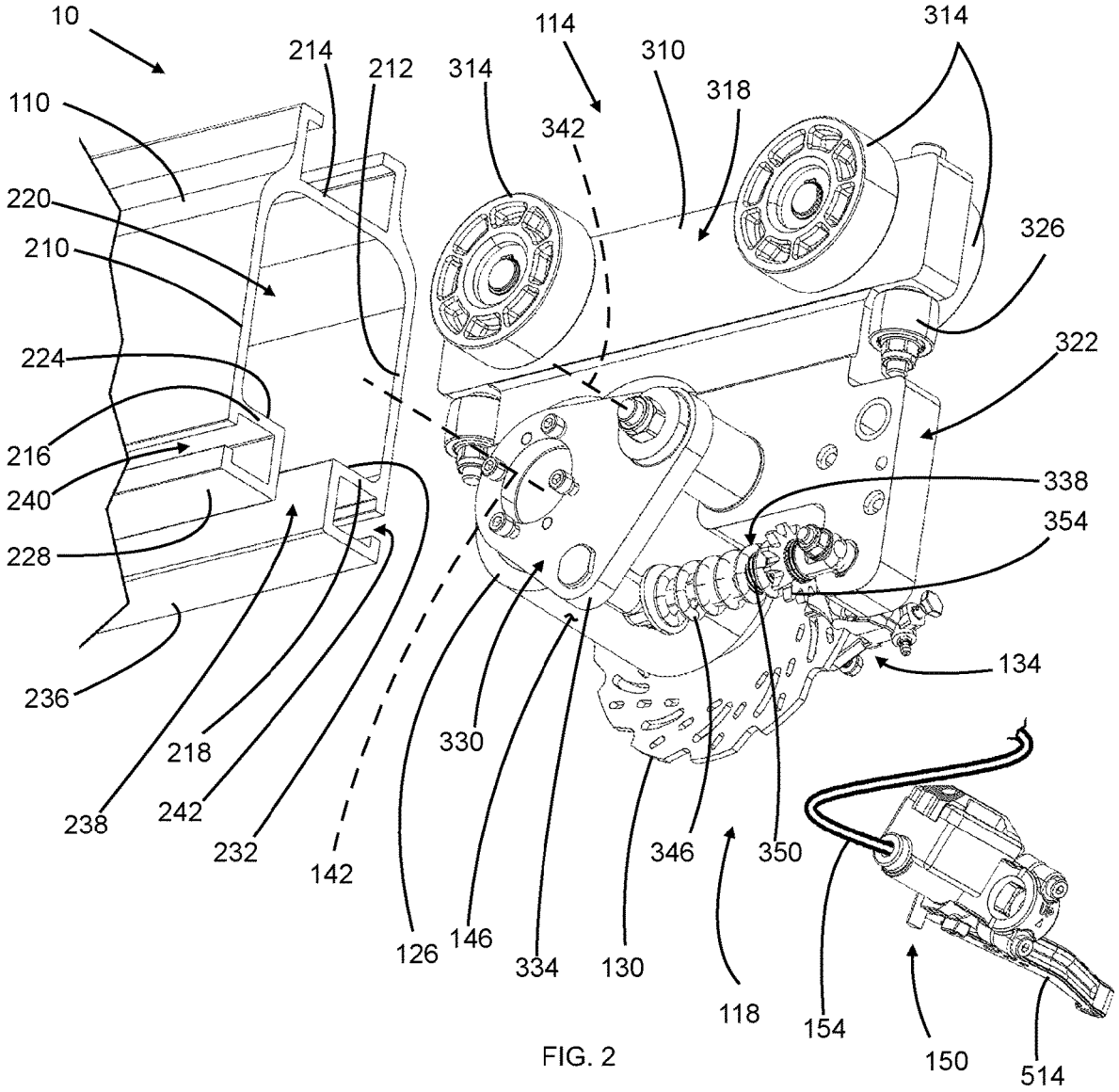
FIG. 2 is a front right perspective view of the hanging trolley system of FIG. 1.

Referring to FIG. 2, the rail 110 of the example provided is known as a C-channel style rail that includes a left side wall 210, a right side wall 212, a top wall 214, a left bottom wall 216, and a right bottom wall 218 that cooperate to define a rail tunnel 220 that runs the longitudinal length of the rail 110 and is centered on the rail axis 122 (FIG. 1). The left and right side walls 210, 212 are coupled together at their tops by the top wall 214. The left bottom wall 216 extends laterally to the right from a bottom of the left side wall 210 such that a top surface 224 of the left bottom wall 216 faces an upward direction and a bottom surface 228 of the left bottom wall 216 faces a downward direction. The right bottom wall 218 extends laterally to the left from a bottom of the right side wall 212 such that a top surface 232 of the right bottom wall 218 faces an upward direction and a bottom surface 236 of the right bottom wall 218 faces a downward direction. The left and right bottom walls 216, 218 are spaced apart to define a gap 238 that is open into the rail tunnel 220 and an exterior of the rail 110.

In the example provided, the left bottom wall 216 may optionally define a left channel 240 and the right bottom wall 218 may optionally define a right channel 242 that are open toward the left and right directions, respectively, and may be between the respective top and bottom surfaces 224, 232 and 228, 236.

Figure 3:
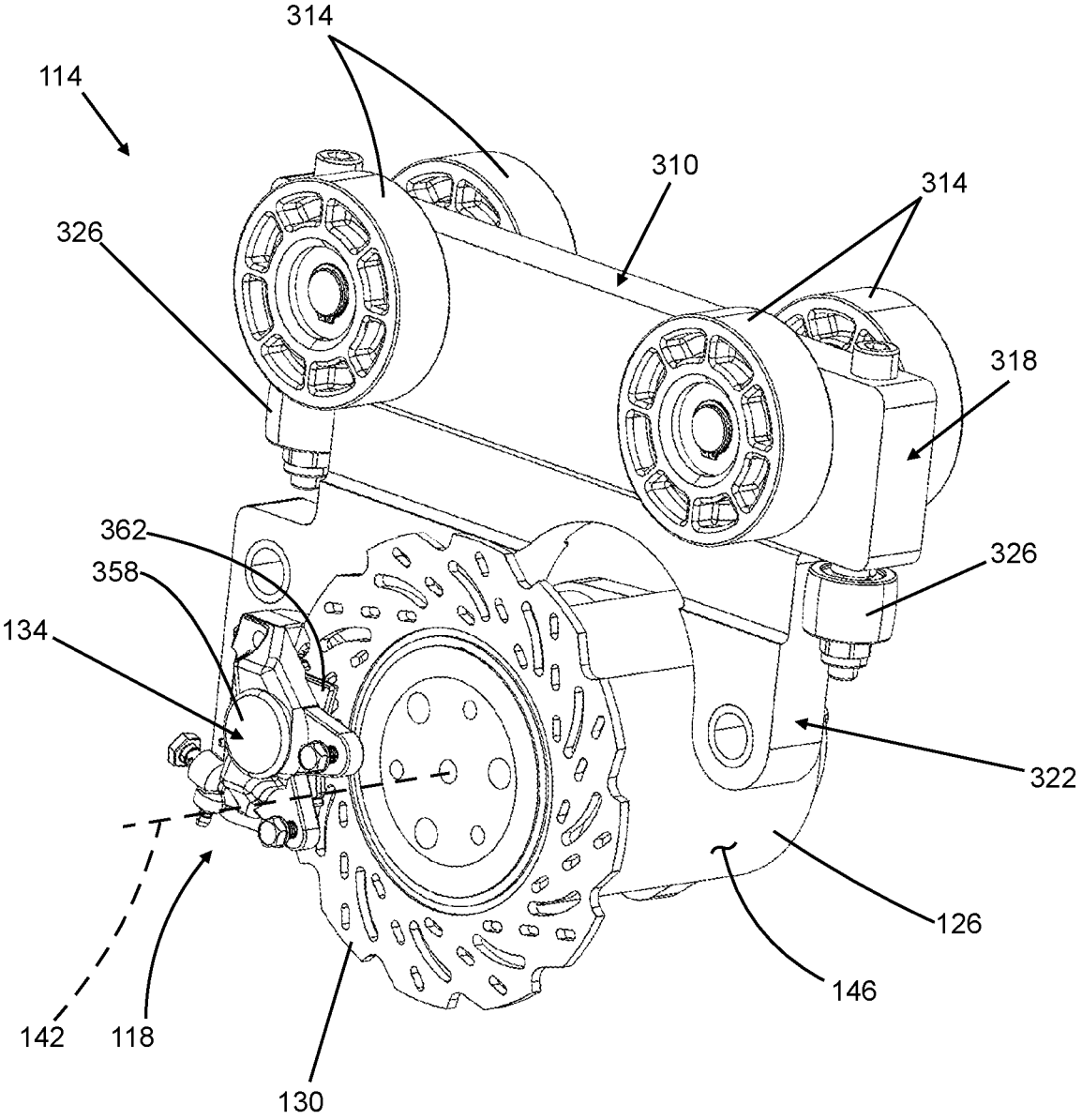
FIG. 3 is a rear left perspective view of a trolley of the overhead trolley system of FIG. 1.
Figure 4:
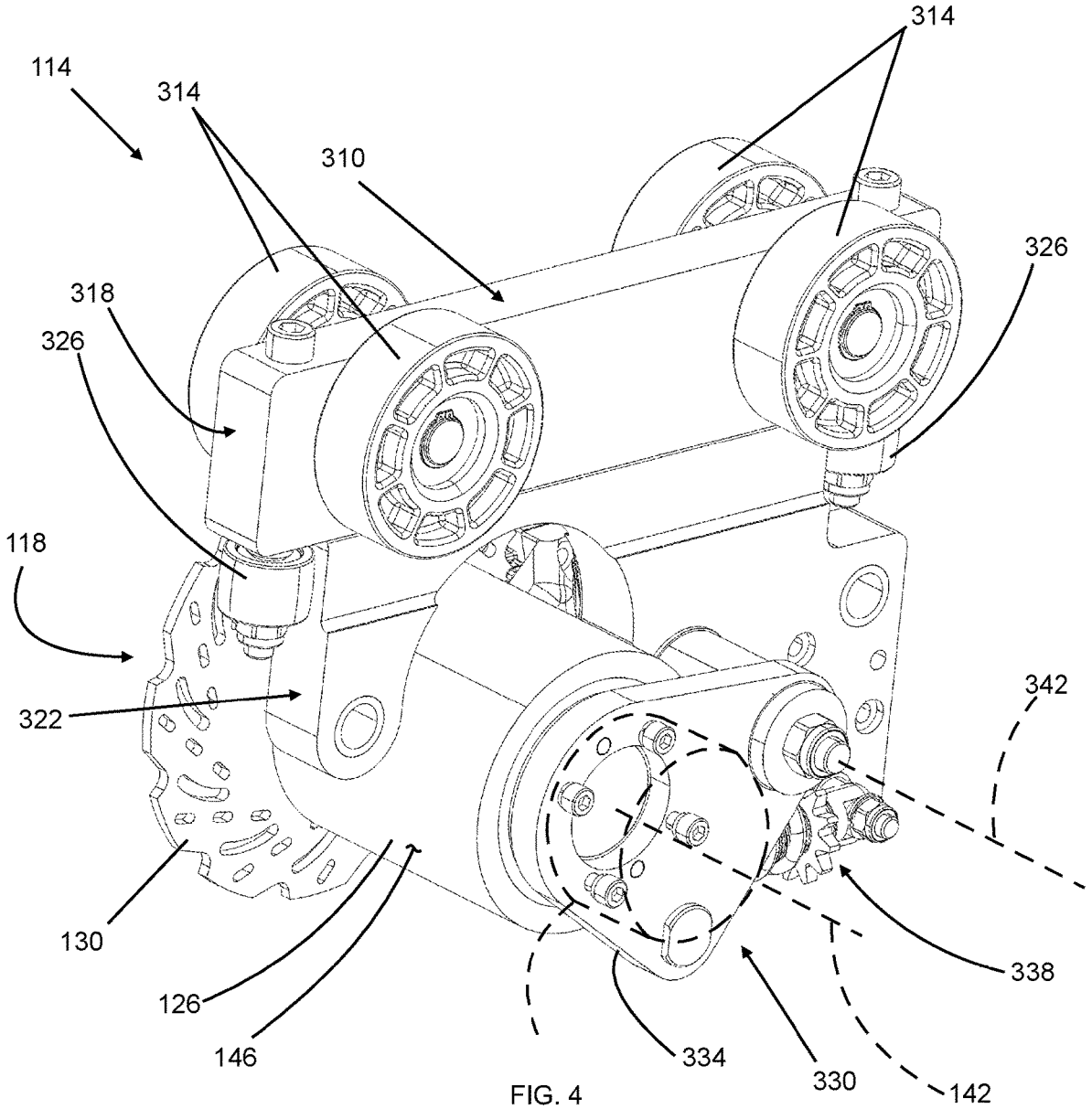
FIG. 4 is a rear right perspective view of the trolley of the overhead trolley system of FIG. 1.

Referring to FIGS. 2-4, the trolley 114 includes a trolley body 310 and a plurality of support wheels 314. The trolley body 310 generally includes an upper portion 318 and a lower portion 322. The support wheels 314 are rotatably coupled to the upper portion 318 and configured to support the trolley body 310 on the rail 110. Each support wheel 314 rotates about its corresponding rotational axis, which are parallel to each other. The lower portion 322 is coupled to the upper portion 318 and is configured to hang down therefrom when the support wheels 314 ride along the rail 110. The lower portion 322 is configured to be attached to the support member 22 (FIG. 1) to support the load 18 (FIG. 1).

In the example provided, a pair of the support wheels 314 are on one side of the upper portion 318 and a pair of the support wheels 314 are on the opposite side of the upper portion 318, though more or fewer support wheels 314 may be on each side, such that the support wheels roll along the top surfaces 224, 232 and the lower portion 322 hangs down through the gap 238.

In the example provided, the trolley 114 may optionally include a plurality of stabilizer wheels 326 that are rotatably coupled to the upper portion 318 and/or the lower portion 322. The rotational axis of each stabilizer wheel 326 is perpendicular to the rotational axes of the support wheels 314. The stabilizer wheels 326 are configured to roll along the left bottom wall 216 or the right bottom wall 218 within the gap 238.

The traction wheel 126 is rotatably coupled to the lower portion 322. The rolling surface 146 of the traction wheel 126 is configured to roll along an exterior surface of the rail 110 when the trolley body 310 is supported by the support wheels 314 on the rail 110. In the example provided, the rolling surface 146 rolls along the bottom surfaces 228, 236. In an alternative configuration, not specifically shown, the rolling surface 146 rolls along only one of the bottom surfaces 228, 236. In the example provided, the rolling surface 146 that contacts the rail 110 can be any suitable material configured to provide rolling friction with the rail 110 and inhibit sliding friction therewith. In some examples this rolling surface 146 may be rubber or polymer, though other materials may be used. In one form, not specifically shown, the rolling surface 146 of the traction wheel 126 may define gear teeth configured to mesh with mating gear teeth on the rail 110, such as a rack and pinion system for example.

The trolley 114 may optionally include a drive motor 410 (schematically shown in dashed lines in FIG. 4) drivingly coupled to the traction wheel 126. Such a drive motor 410 may be controlled by the controller 150.

The trolley 114 may optionally include a tensioner 330 that biases the traction wheel 126 into contact with the rail 110. In the example provided, the tensioner 330 includes an arm 334 and a biaser 338. The arm 334 is rotatably coupled to the lower portion 322 to pivot about a pivot axis 342. The traction wheel 126 is rotatably coupled to the arm 334 such that the rotational axis 142 of the traction wheel 126 is parallel to the pivot axis 342. The biaser 338 is configured to bias the arm 334 to pivot about its pivot axis 342 in a direction that biases the traction wheel 126 toward the surface of the rail 110 on which it rolls (e.g., the bottom surfaces 228, 236). In the example provided, the biaser 338 includes a spring 346 disposed about a gas shock 350. The biaser 338 may optionally include an adjustment mechanism to adjust the biasing force. In the example provided, the adjustment mechanism includes a nut 354 threadably coupled to the outside of the gas shock 350 such that rotating the nut 354 compresses or decompresses the spring 346. In another configuration, not specifically shown, the biaser 338 may be a spring without a gas shock, a gas shock without a spring, a resilient material or an air cylinder (i.e., a pneumatic cylinder). In the example provided, the biaser 338 has one end coupled to the lower portion 322 and another end coupled to the arm 334 at a location offset from the pivot axis 342. In a different configuration, not specifically shown, the biaser 338 may be a clock-spring or other rotationally biasing device disposed coaxially about the pivot axis 342 and configured to bias rotation of the arm 334 thereabout.

In the example provided, the first component 130 is a brake rotor coupled coaxially to the traction wheel 126 for common rotation therewith about the traction wheel's 126 rotational axis 142.

In the example provided, the second component 134 can be an assembly that includes a caliper 358 and a set of brake pads 362. The caliper 358 is supported by the lower portion 322 in a position to straddle the rotor. The brake pads 362 are mounted in the caliper 358 on opposite sides of the rotor. The caliper 358 is configured to selectively compress the brake pads 362 against the sides of the rotor to selectively inhibit rotation of the rotor and thus the traction wheel 126.

Figure 8:
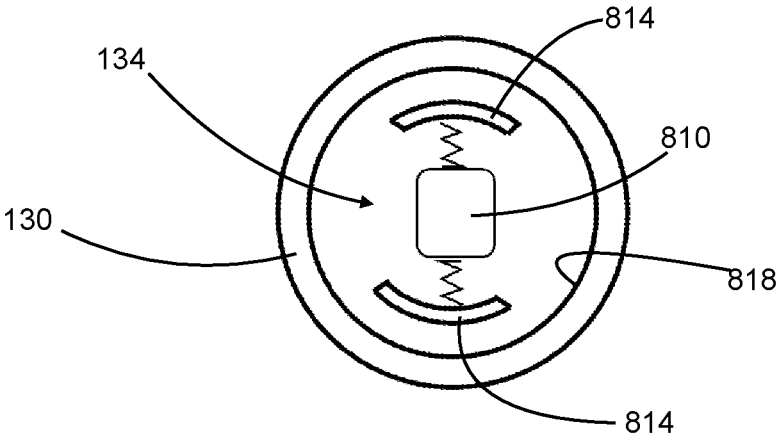
FIG. 8 is a schematic side view of a portion of a trolley system of a fourth form according to the present disclosure.

In an alternative configuration, not specifically shown, the caliper 358 and brake pads 362 can be replaced with an air brake system such that compressed air is directed at the rotor to slow rotation thereof. In another alternative configuration, not specifically shown, the caliper 358 and brake pads 362 may be replaced with a magnetic brake system. In still another alternative configuration, shown in FIG. 8, the first component 130 can be a brake drum instead of a rotor and the second component 134 can include an actuator 810 and a set of brake shoes 814. The actuator is configured to selectively compress the brake shoes 814 against an inner cylindrical surface 818 of the brake drum to selectively inhibit rotation of the brake drum and thus the traction wheel 126.

Figure 5:
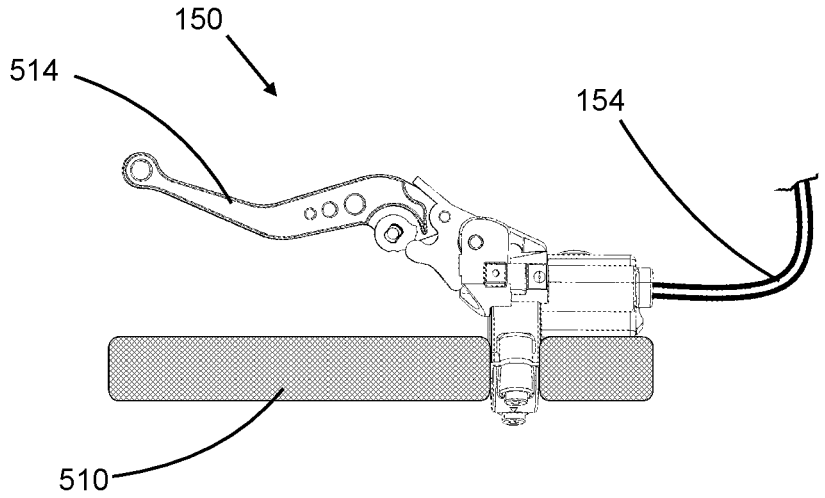
FIG. 5 is a top view of a handle of the overhead trolley system of FIG. 1.

Returning to the example provided, with reference to FIGS. 2 and 5, the controller 150 can include a handle 510 (FIG. 5) and a lever 514. The lever 514 is coupled to the cable 154. In one form, the cable 154 is a Bowden cable that includes a mechanical cable slidably received in an outer sheath and actuation of the lever 514 is configured to pull on the cable within the sheath to actuate the second component 134. In another form, the cable 154 is a pneumatic or hydraulic cable and actuation of the lever 514 is configured to actuate the second component 134 via pneumatic or hydraulic pressure. In yet another form, the cable 154 is an electrical cable and actuation of the lever 514 is configured to provide an electrical signal to actuate the second component 134 to inhibit rotation of the first component 130. In an alternative form, not specifically shown, the lever 514 may be replaced by a button or other input device that provides the electrical signal via the cable 154 or wirelessly without a cable.

Figure 6:
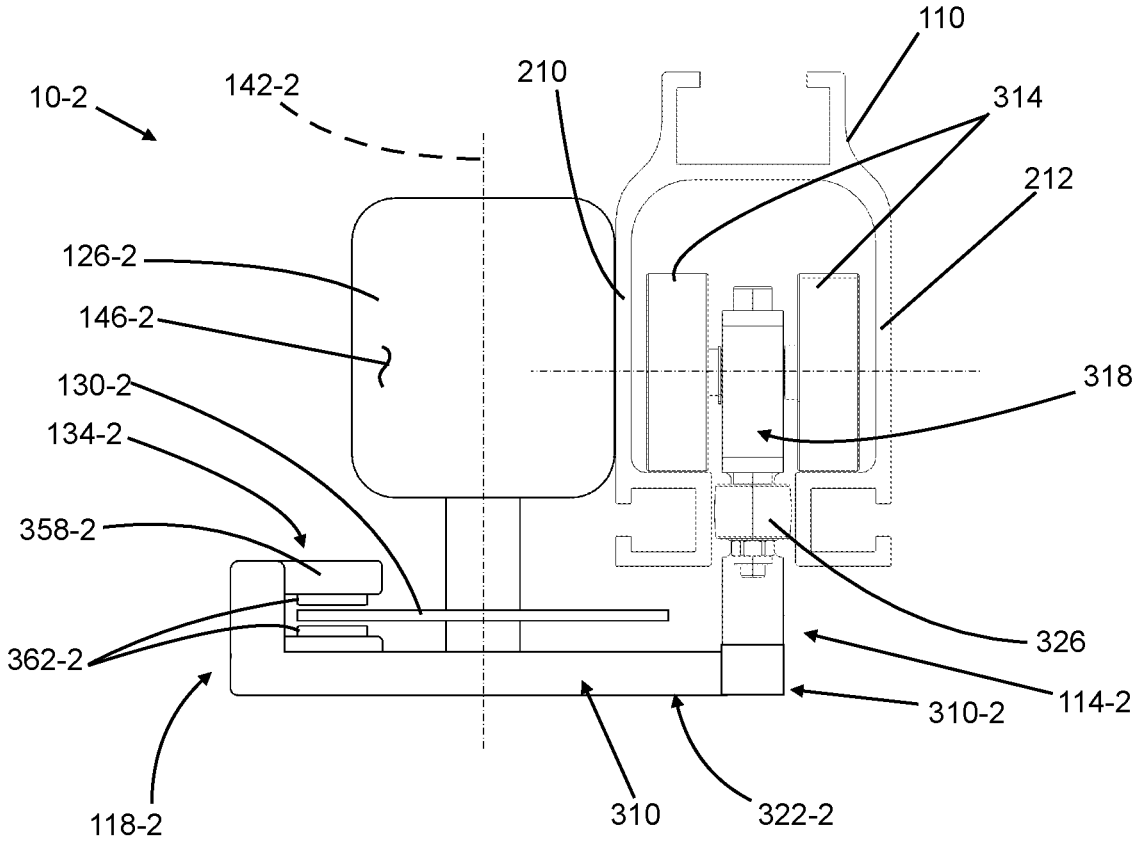
FIG. 6 is a schematic front view of an overhead trolley system of a second form according to the present disclosure.

Referring to FIG. 6, an alternative form of the trolley system 10 is illustrated and indicated by reference numeral 10-2. The trolley system 10-2 can be similar to the trolley system 10, except as otherwise shown or described herein. Accordingly, only differences are described in detail and similar features are indicated with similar numbers with a "-2" suffix. The lower portion 322-2 of the trolley body 310-2 extends laterally outside the rail 110 and supports the traction wheel 126-2 such that its rotational axis 142-2 is transverse (e.g., perpendicular) to the rotational axes of the support wheels 314-2. In this example, the traction wheel 126-2 rolls along an exterior surface of the left side wall 210. In an alternative configuration, not specifically shown, the lower portion 322-2 can extend in the opposite lateral direction so that the traction wheel 126-2 can roll along the right side wall 212 instead of the left side wall 210. While not specifically illustrated, the a tensioner similar to the tensioner 330 (FIGS. 2-4) can couple the traction wheel 126-2 to the lower portion 322-2.

Figure 7:
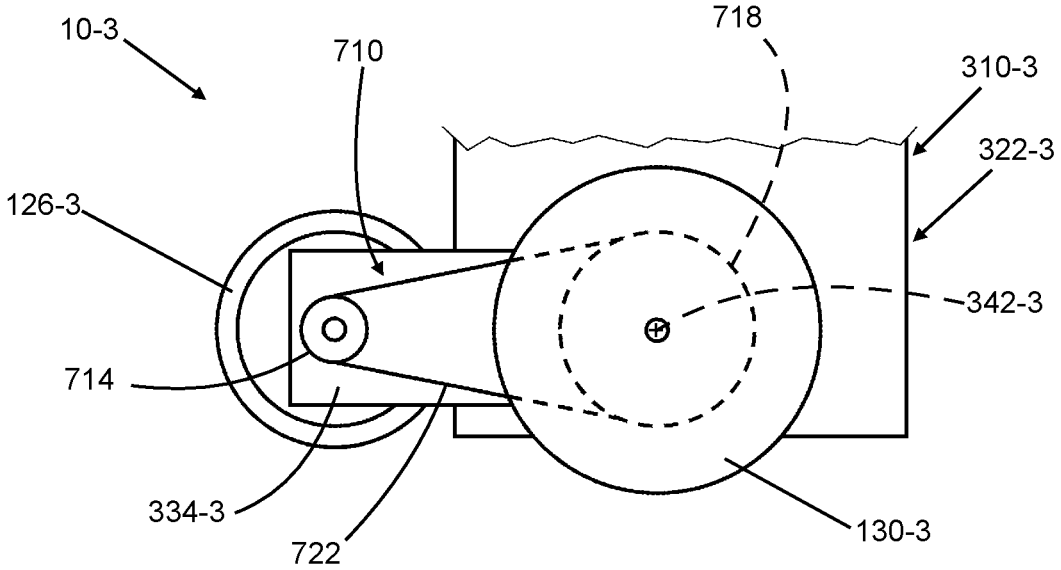
FIG. 7 is a schematic side view of a portion of a trolley system of a third form according to the present disclosure.

Referring to FIG. 7, a portion of a trolley system of another form is illustrated and indicated by reference numeral 10-3. The trolley system 10-3 can be similar to the trolley system 10 or 10-2, except as otherwise shown or described herein. Accordingly, only differences are described in detail and similar features are indicated with similar numbers with a "-3" suffix. In this example, the traction wheel 126-3 is drivingly coupled to the first component 130-3 via a transmission 710. The traction wheel 126-3 is still rotatably coupled to the arm 334-3, which may optionally be rotationally biased relative to the lower portion 322-3 of the trolley body 310-3, as discussed above. The transmission 710 provides a torque increase or reduction between the traction wheel 126-3 and the first component 130-3.

In the example provided, the transmission 710 includes a first pulley 714 coaxially coupled to the traction wheel 126-3 for common rotation therewith. The first pulley 714 is drivingly coupled to a second pulley 718 via a belt 722, though other configurations can be used. For example, the belt 722 may be replaced with a chain and the pulleys may have sprocket teeth to engage the chain, or the pulleys may be replaced with gears meshingly engaged with each other instead of a belt. While not shown, the transmission 710 may optionally include a belt tensioner to maintain tension on the belt 722. The second pulley 718 is coupled to the first component 130-3 for common rotation therewith. In the example provided, the first pulley 714 has a smaller diameter than the second pulley 718, though other configurations can be used, such as a larger diameter. While only two pulleys are illustrated, additional pulleys or similar components (e.g., gears, sprockets) may be used to achieve the desired torque increase or reduction. In the example provided, the second pulley 718 and the first component 130-3 may be coaxial with the pivot axis 342-3. In another form, not specifically shown, the second pulley 718 and the first component 130-3 may be coupled to the arm 334-3 at a position offset from the pivot axis 342-3 for common pivoting with the arm 334-3 about the pivot axis 342-3. In another alternative form, not specifically shown, the second pulley 718 and the first component 130-3 may be coupled to the lower portion 322-3 of the trolley body 310-3. In such a form, the pivoting of the arm 334-3 may also function to maintain tension on the belt 722.

Figure 9:
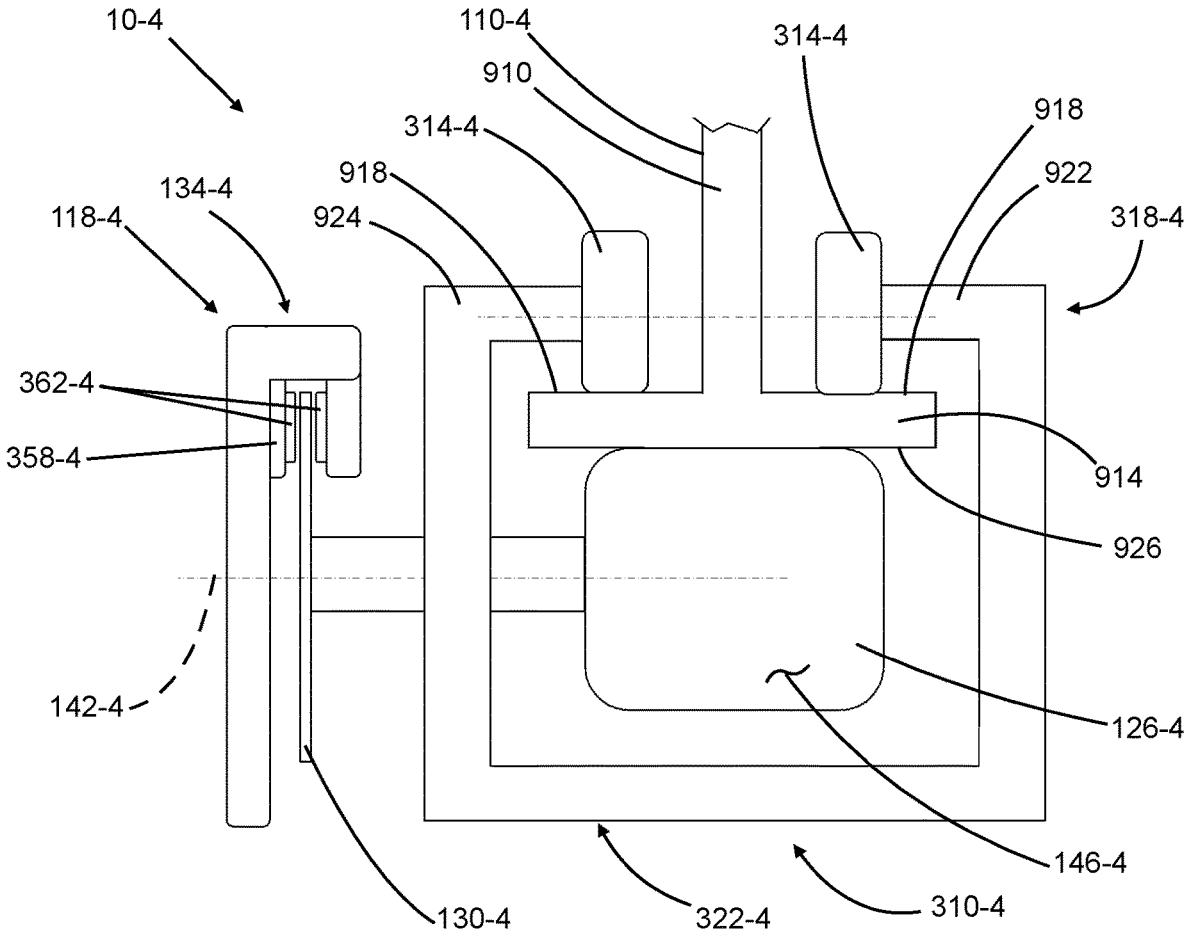
FIG. 9 is a schematic front view of an overhead trolley system of a fifth form according to the present disclosure.

Referring to FIG. 9, a portion of a trolley system of yet another form is illustrated and indicated by reference numeral 10-4. The trolley system 10-4 can be similar to the trolley system 10, 10-2, or 10-3 except as otherwise shown or described herein. Accordingly, only differences are described in detail and similar features are indicated with similar numbers with a "-4" suffix. In this example, the rail 110-4 is an "I-beam" style rail or an inverted "T" style rail instead of a "C" channel. In this form, the rail 110-4 has a vertical stanchion 910 and a horizontal stanchion 914 extending laterally in opposite directions from a bottom of the vertical stanchion 910. The support wheels 314-4 ride along the top surfaces 918 of the horizontal stanchion 914. The upper portion 318-4 of the trolley body 310-4 is formed by two separate parts 922 and 924 joined together by the lower portion 322-4 of the trolley body 310-4. The lower portion 322-4 of the trolley body 310-4 hangs below the horizontal stanchion 914 and supports the traction wheel 126-4 in contact with a bottom surface 926 of the horizontal stanchion 914.

In an alternative configuration, not specifically shown, the first component 130-4 may be coupled to one of the support wheels 314-4 for common rotation therewith such that this particular support wheel 314-4 also acts as the traction wheel 126-4.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A hanging trolley system comprising:

a body including an upper portion and a lower portion;

a plurality of first support wheels coupled to the upper portion of the body for rotation relative thereto about corresponding first axes that are parallel to each other, the first support wheels being configured to roll on an upward facing first surface of a rail to support the body on the rail; and a brake system including a traction wheel, a first component, and a second component, wherein the traction wheel is coupled to the lower portion of the body for rotation relative thereto about a second axis and is configured to roll along a second surface of the rail, wherein the first component is coupled to the traction wheel for rotation therewith, wherein the second component is configured to selectively inhibit rotation of the first component.

2. The hanging trolley system according to claim 1, wherein the second axis is parallel to the first axes.

3. The hanging trolley system according to claim 2, wherein the second surface is a downward facing surface such that the traction wheel is configured to be below the first support wheels when the first support wheels support the body on the rail.

4. The hanging trolley system according to claim 1, wherein the second axis is transverse to the first axes.

5. The hanging trolley system according to claim 1, further comprising a motor drivingly coupled to the traction wheel.

6. The hanging trolley system according to claim 1, further comprising a tensioner supported by the body and configured to bias the traction wheel toward the second surface.

7. The hanging trolley system according to claim 6, wherein the tensioner includes a biaser and an arm, wherein the arm pivotably couples the traction wheel to the lower portion of the body, wherein the biaser biases the arm in a predetermined pivot direction, wherein the biaser is at least one of a spring, a gas shock, a resilient material, and an air cylinder.

8. The hanging trolley system according to claim 1, further comprising a plurality of second support wheels coupled to the upper portion of the body for rotation relative thereto, each second support wheel being rotatable about a corresponding one of the first axes, the second support wheels being configured to roll on an upward facing third surface of the rail to support the body on the rail.

9. The hanging trolley system according to claim 1, further comprising a hand lever and a Bowden cable, wherein one end of the Bowden cable is coupled to the second component and an opposite end of the Bowden cable is coupled to the hand lever, the hand lever being configured to actuate the second component via the Bowden cable.

10. The hanging trolley system according to claim 1, further comprising a hand lever and a cable, wherein one end of the cable is coupled to the second component and an opposite end of the cable is coupled to the hand lever, the hand lever being configured to actuate the second component via the cable, wherein the cable is a hydraulic or pneumatic cable.

11. The hanging trolley system according to claim 1, further comprising a controller and an actuator, wherein the actuator is configured to activate the second component to engage the first component, the controller being configured to send a signal to the actuator to activate the second component to engage the first component.

12. The hanging trolley system according to claim 1, wherein the first component is directly coupled to the traction wheel for common rotation about the second axis therewith.

13. The hanging trolley system according to claim 1, wherein the first component is directly coupled to a transmission member that is drivingly coupled to the traction wheel for rotation therewith.

14. The hanging trolley system according to claim 1, wherein the first component is a brake rotor and the second component is a caliper.

15. The hanging trolley system according to claim 1, further comprising the rail.

16. A hanging trolley system comprising:

a body including an upper portion and a lower portion;

a plurality of first support wheels coupled to the upper portion of the body for rotation relative thereto about corresponding first axes that are parallel to each other, the first support wheels being configured to roll on an upward facing first surface of a rail to support the body on the rail;

a traction wheel coupled to the lower portion of the body for rotation relative thereto about a second axis, the traction wheel configured to roll along a second surface of the rail;

a brake rotor coupled to the traction wheel for rotation therewith;

a caliper configured to selectively inhibit rotation of the brake rotor; and a hand lever and a cable, wherein one end of the cable is coupled to the caliper and an opposite end of the cable is coupled to the hand lever, the hand lever being configured to actuate the caliper via the cable.

17. The hanging trolley system according to claim 16, wherein the cable is one of a hydraulic cable, a pneumatic cable, a Bowden cable, and an electrical cable.

18. The hanging trolley system according to claim 16, wherein, when the caliper is activated, the caliper resists rotation of the rotor by engaging the rotor with at least one of frictional force and magnetic force.

19. The hanging trolley system according to claim 16, wherein the brake rotor is directly coupled to the traction wheel for common rotation about the second axis therewith.

20. A hanging trolley system comprising:

a body including an upper portion and a lower portion;

a plurality of first support wheels coupled to the upper portion of the body for rotation relative thereto about corresponding first axes that are parallel to each other, the first support wheels being configured to roll on an upward facing first surface of a rail to support the body on the rail;

a plurality of second support wheels coupled to the upper portion of the body for rotation relative thereto, each second support wheel being rotatable about a corresponding one of the first axes, the second support wheels being configured to roll on an upward facing third surface of the rail to support the body on the rail;

a traction wheel coupled to the lower portion of the body for rotation relative thereto about a second axis, the traction wheel configured to roll along a second surface of the rail;

a tensioner supported by the body and configured to bias the traction wheel toward the second surface;

a brake rotor coupled to the traction wheel for rotation therewith;

a caliper configured to selectively inhibit rotation of the brake rotor; and a hand lever and a cable, wherein one end of the cable is coupled to the caliper and an opposite end of the cable is coupled to the hand lever, the hand lever being configured to actuate the caliper via the cable, wherein the cable is one of a hydraulic cable, a pneumatic cable, a Bowden cable, and an electrical cable.

* * * * *